US007112917B2

(12) United States Patent
Behr et al.

(10) Patent No.: US 7,112,917 B2
(45) Date of Patent: Sep. 26, 2006

(54) LAMP BASE AND A LAMP HAVING A LAMP BASE WITH MULTIPLE SETS OF CONTACTS

(75) Inventors: Gerhard Behr, Altheim (DE); Peter Helbig, Sontheim (DE)

(73) Assignee: Osram Sylvania Inc., Danvers, MA (US)

( * ) Notice: Subject to any disclaimer, the term of this patent is extended or adjusted under 35 U.S.C. 154(b) by 193 days.

(21) Appl. No.: 10/753,320

(22) Filed: Jan. 9, 2004

(65) Prior Publication Data

US 2004/0140750 A1 Jul. 22, 2004

(30) Foreign Application Priority Data

Jan. 16, 2003 (DE) ..... 203 00 699 U

(51) Int. Cl.
*F21V 19/00* (2006.01)
*H01J 5/50* (2006.01)

(52) U.S. Cl. ..... 313/318.01; 313/318.12; 362/548; 362/549

(58) Field of Classification Search ..... 313/318.01, 313/318.05, 318.06, 318.09, 318.12; 362/548, 362/549, 353

See application file for complete search history.

(56) References Cited

U.S. PATENT DOCUMENTS 2,317,032 A 4/1943 Cotman
4,528,619 A 7/1985 Dolan
5,010,272 A 4/1991 Eckhardt et al.
5,957,569 A 9/1999 Helbig et al.
6,080,019 A 6/2000 Coushaine
6,244,737 B1 6/2001 Werner et al.
6,467,942 B1 * 10/2002 Alloway et al. ..... 362/549
2002/0163288 A1 * 11/2002 Behr et al. ..... 313/318.01

FOREIGN PATENT DOCUMENTS

DE 6 89 07 108.5 9/1989
DE 295 07 879 5/1995
EP 0 376 260 7/1990
WO WO 97/25733 7/1997

* cited by examiner

*Primary Examiner*—Karabi Guharay
(74) *Attorney, Agent, or Firm*—William E. Meyer

(57) ABSTRACT

The invention relates to a lamp base having fastening means for a lamp vessel, having a base part that consists of an electrically insulating material and that is equipped with at least two first electric contacts that serve the power supply of at least one luminous means, wherein said base part has at least two second electric contacts, in each case one of said second electric contacts being connected in an electrically conducting fashion to in each case one of said first electric contacts.

4 Claims, 2 Drawing Sheets

LAMP BASE AND A LAMP HAVING A LAMP BASE WITH MULTIPLE SETS OF CONTACTS

I. TECHNICAL FIELD

Figure 1:
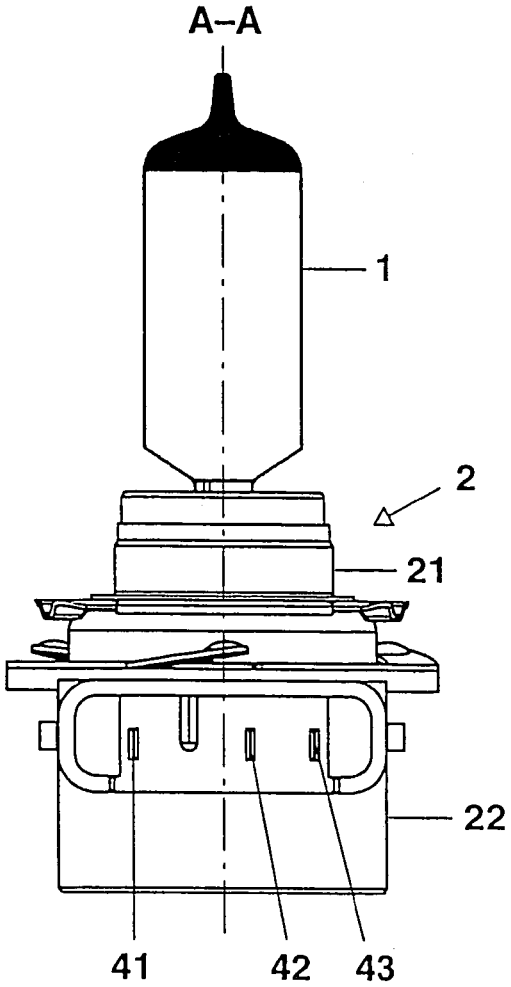

The invention relates to a lamp base having fastening means for a lamp vessel, having a base part that consists of an electrically insulating material and that is equipped with at least two first electric contacts that serve the power supply of at least one luminous means, and to a lamp having such a lamp base.

II. BACKGROUND ART

Such a lamp base and corresponding lamps are disclosed, for example, in the International Patent Application bearing the publication number WO 97/25733, and in the German Utility Model DE 89 07 108 U.

The aforesaid International Patent Application describes a motor vehicle headlight having a lamp base that has an angular plastic base part from which project two electric contacts of the lamp that are designed as contact lugs. The contact lugs extend transverse to the longitudinal axis of the lamp or the lamp vessel.

The abovenamed Utility Model describes a motor vehicle headlight having a lamp base that has an electrically insulating base insulator that is made from ceramic or plastic and from which project two electric contacts designed as contact lugs. The contact lugs extend in the direction of the longitudinal axis of the lamp or the lamp vessel.

The two aforesaid publications disclose two different options for making contact that are customary for motor vehicle headlights.

III. DISCLOSURE OF THE INVENTION

It is the object of the invention to provide a lamp base and a lamp that offer two different options for making contact.

This object is achieved by a lamp base which has fastening means for a lamp vessel, and a base part that consists of an electrically insulating material and that is equipped with at least two first electric contacts that serve the power supply of the at least one luminous means. In addition, the base part is provided with at least two second electric contacts, in each case one of said second electric contacts being connected in an electrically conducting fashion to one of said first electric contacts. A further option for making contact is created for the lamp and/or for the luminous means of the lamp by means of the aforesaid second electric contacts. It is therefore optionally possible to use the first or second electric contacts for making contact with the lamp.

Particularly advantageous designs of the invention are described in the dependent claims.

The second electric contacts are advantageously respectively connected to a first electric contact and are arranged transverse to the respective first electric contact. This creates two contact planes that are situated transverse to one another and can be used optionally. In accordance with the preferred exemplary embodiment of the invention, the second electric contacts and the respective first electric contacts connected to them are designed as unipartite angular contact lugs. Consequently, the electric contacts can be produced in a simple way as sheet metal stampings and have a high mechanical stability. The base part advantageously consists of an electrically insulating, heat resistant plastic such that the base part can be designed as an injection-molded part in which the electric contact can be embedded.

The lamp according to the invention has at least one luminous means that is surrounded by at least one lamp vessel, and a lamp base that is fixed on the at least one lamp vessel and that has a base part that consists of an electrically insulating material and is provided with at least two first electric contacts that are connected in an electrically conducting fashion to the at least one luminous means. In addition, the aforesaid base part has at least two second electric contacts, in each case one second electric contact being connected in an electrically conducting fashion to one first electric contact. A further option for making contact is created for the lamp or for the luminous means of the lamp by means of the aforesaid second electric contacts. It is therefore optionally possible to use either the first or second electric contacts for making contact with the lamp.

The electric contacts of the lamp are advantageously designed as contact lugs, the first electric contacts extending in the direction of the longitudinal extent of the lamp, and the second electric contacts extending transverse to the longitudinal extent of the lamp. This renders it possible to make electric contact with the lamp both in the longitudinal direction and transverse thereto, and so the lamp can be used in headlights having differently arranged connectors. In particular, the lamp according to the invention is also suitable for use in headlights that usually require lamps having an angular base.

IV. BRIEF DESCRIPTION OF THE DRAWINGS

Figure 2:
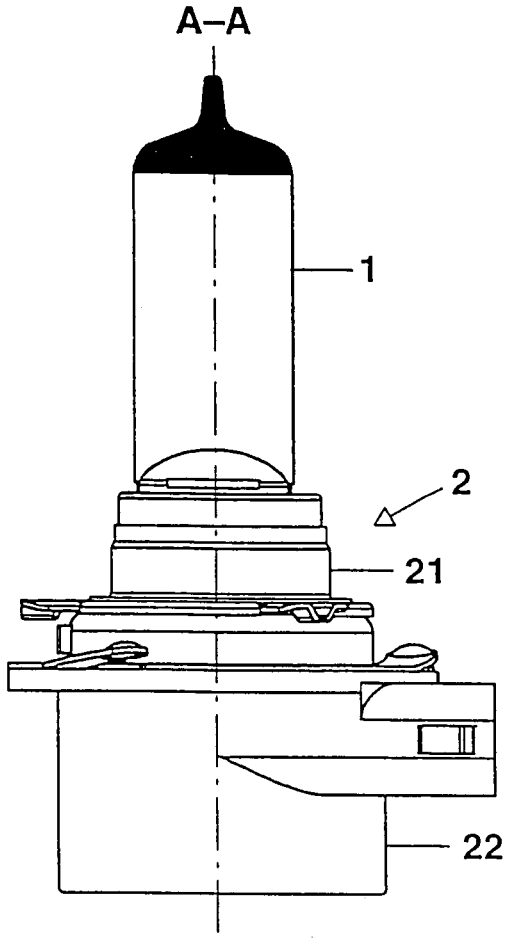
Figure 3:
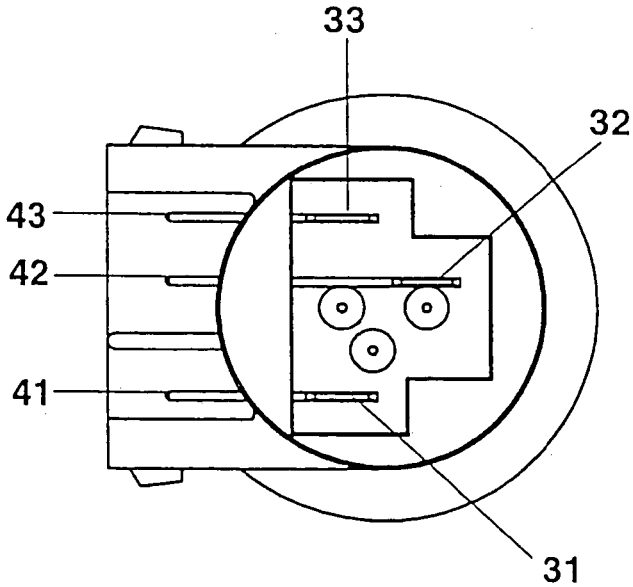
Figure 4:
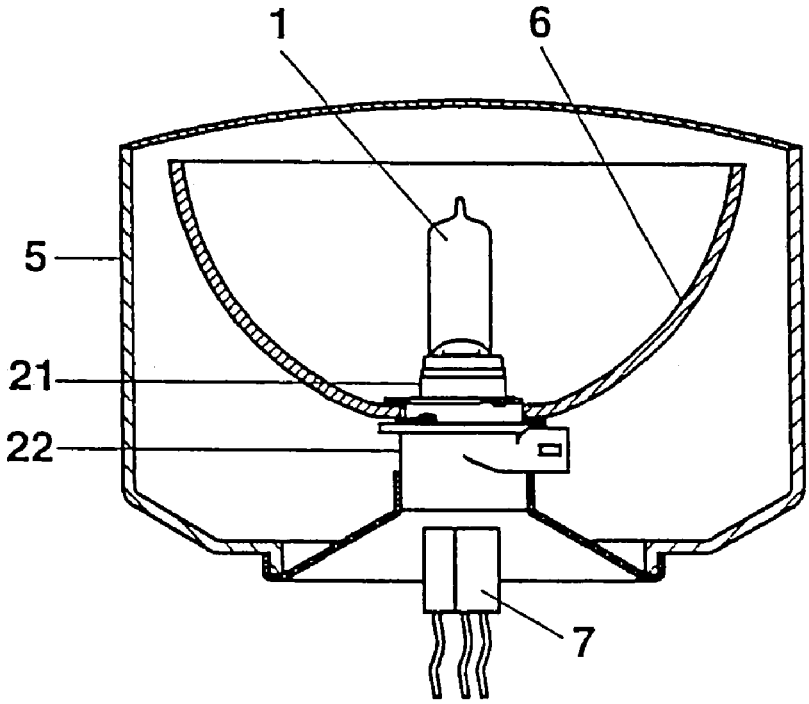
Figure 5:
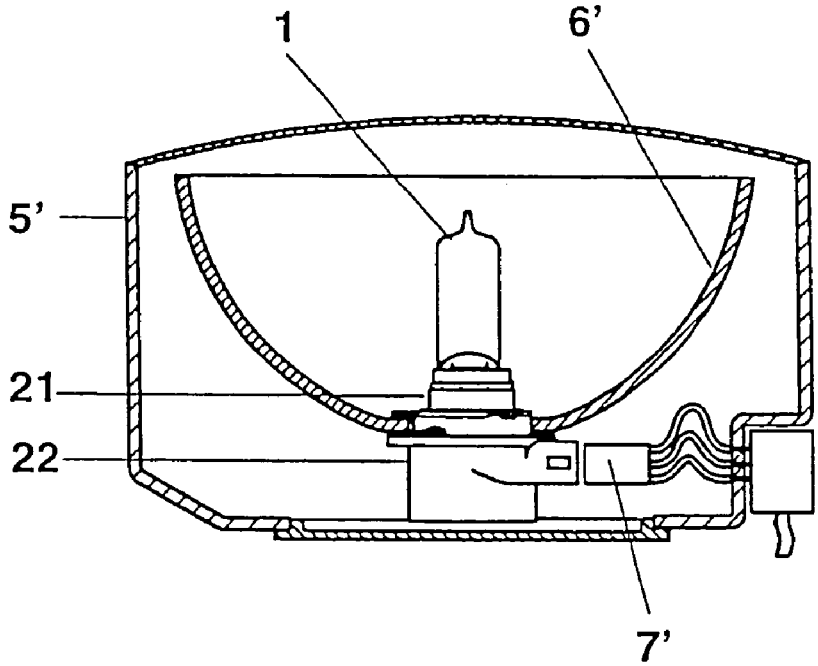

The invention is explained in more detail below with the aid of a preferred exemplary embodiment. In the drawings:

FIG. 1 shows a first side view of a preferred exemplary embodiment of the invention, FIG. 2 shows a second side view of the exemplary embodiment illustrated in FIG. 1, in a view rotated by 90 degrees by comparison with FIG. 1, FIG. 3 shows a plan view of the base and the electric contacts of the exemplary embodiment illustrated in FIG. 1, FIG. 4 shows the mounting of the lamp illustrated in FIG. 1 in a headlight where electric contact is made at the rear, and FIG. 5 shows the mounting of the lamp illustrated in FIG. 1 in a headlight where electric contact is made at the side.

V. BEST MODE FOR CARRYING OUT THE INVENTION

The preferred exemplary embodiment of the invention illustrated in FIG. 1 is a halogen incandescent lamp that is provided for use in a vehicle headlight. This lamp has a transparent, vitreous lamp vessel 1 that is substantially cylindrical and surrounds two incandescent filaments (not illustrated) and is fixed in a lamp base 2. The lamp base 2 comprises a plurality of metallic base parts 21 that are welded to one another and serve for holding the lamp vessel 1 and for mounting the lamp in a headlight, and a plastic base part 22 that is provided with the electric connections of the lamp. The aforesaid electric connections are designed as two triples of contact lugs 31, 32, 33 or 41, 42, 43, respectively, and serve for supplying power to the incandescent filaments enclosed in the lamp vessel 1. Either the first triple of contact lugs 31, 32, 33 or the second triple of contact lugs 41, 42, 43 is used to make electric contact with the lamp in the headlight. The contact lugs 31, 32, 33 of the first triple extend in the longitudinal direction A—A of the lamp, and the contact lugs 41, 42, 43 of the second triple extend transverse to the longitudinal axis A—A. The first contact lug 31 of the first triple is connected in an electrically conducting fashion to the first contact lug 41 of the second triple. As may be seen from FIG. 3, the first contact lugs 31, 41 comprise an angular or L-shaped first sheet metal stamping, of which one limb is directed in the direction of the longitudinal axis A—A and forms the contact lug 31, and of which the other limb is arranged transverse to the longitudinal axis A—A and forms the contact lug 41. Similarly, the two contact lugs 32, 42 comprise an angular or L-shaped second sheet metal stamping, of which one limb is directed in the direction of the longitudinal axis A—A and forms the contact lug 32, and of which the other limb is arranged transverse to the longitudinal axis A—A and forms the contact lug 42. Correspondingly, the third contact lugs 33, 43 comprise an angular or L-shaped third sheet-metal stamping, of which one limb is directed in the direction of the longitudinal axis A—A and forms the contact lug 33, and of which the other limb is arranged transverse to the longitudinal axis A—A and forms the contact lug 43.

Two different options for making contact with the above-described lamp in a motor vehicle headlight are illustrated in FIGS. 4 and 5. The headlight 5 depicted in FIG. 4 has a plug 7, arranged at the rear, for making electric contact with the lamp. The lamp is fixed in the vertex opening of the reflector 6 in the headlight 5 by means of its metallic base part 21. The plug 7 is plugged onto the contact lugs 31, 32, 33 in order to make electric contact with the lamp.

The headlight 5' illustrated in FIG. 5 has a laterally arranged plug 7' for making electric contact with the lamp. The lamp is fixed in the vertex opening of the reflector 6' in the headlight 5' by means of its metallic base part 21. The plug 7' is plugged onto the contact lugs 41, 42, 43 in order to make electric contact with the lamp.

The invention is not limited to the exemplary embodiment explained in more detail above, but can also be used, for example, on lamps that have only one incandescent filament and thus two electric contacts. In this case, the lamp according to the invention has two pairs instead of two triples of electric contacts, which are designed and arranged in the same way as described above.

What is claimed is:

1. A lamp base having fastening means for a lamp vessel, having a base part that consists of an electrically insulating material and that is equipped with at least two first electric contacts formed mechanically to mate with an electrical plug and thereby supply electric power to at least one luminous means, wherein said base part has at least two second electric contacts formed to mate mechanically with an alternative electrical plug and supply electric power to the same at least one luminous means, in each case one of said second electric contacts being connected in an electrically conducting fashion to in each case one of said first electric contacts.

2. The lamp base as claimed in claim 1, wherein said second electric contact is mechanically connected to said respective first electric contact, and said second electric contacts are arranged transverse to said respective first electric contact.

3. The lamp base as claimed in claim 2, wherein the second electric contacts and the respective first electric contacts connected to them are designed as unipartite, angular contact lugs.

4. The lamp base as claimed in claim 1, wherein the base part consists of an electrically insulating plastic.

* * * * *